US007717585B2

(12) United States Patent
Bole

(10) Patent No.: US 7,717,585 B2
(45) Date of Patent: May 18, 2010

(54) STRING, CHAIN AND LUMINOUS DEVICE WITH LIGHT-EMITTING DIODES AND LIGHT-EMITTING DIODE SUPPORT

(75) Inventor: Philippe Bole, Sainte Marie d'Alloix (FR)

(73) Assignee: PBLB, Le Champ Pres Froges (FR)

( * ) Notice: Subject to any disclaimer, the term of this patent is extended or adjusted under 35 U.S.C. 154(b) by 404 days.

(21) Appl. No.: 11/579,933

(22) PCT Filed: Jan. 21, 2005

(86) PCT No.: PCT/FR2005/000146

§ 371 (c)(1),
(2), (4) Date: Sep. 5, 2007

(87) PCT Pub. No.: WO2005/122647

PCT Pub. Date: Dec. 22, 2005

(65) Prior Publication Data

US 2008/0285278 A1 Nov. 20, 2008

(30) Foreign Application Priority Data

May 10, 2004 (FR) ..... 04 05033

(51) Int. Cl.
*F21V 21/00* (2006.01)

(52) U.S. Cl. ..... 362/249.02; 362/310; 362/806

(58) Field of Classification Search ..... 362/249.02, 362/249.03–249.06, 310, 249.14–249.19, 362/806–811
See application file for complete search history.

(56) References Cited

U.S. PATENT DOCUMENTS 4,173,035 A 10/1979 Hoyt
4,628,422 A * 12/1986 Ewald ..... 362/240
5,068,771 A * 11/1991 Savage, Jr. ..... 362/255
5,584,122 A * 12/1996 Kato et al. ..... 29/872
5,769,533 A 6/1998 Yamuro et al.
7,186,012 B2 * 3/2007 Schevardo et al. ..... 362/555
7,334,919 B2 * 2/2008 Wu ..... 362/267
2004/0141319 A1 7/2004 Huang

FOREIGN PATENT DOCUMENTS

DE 19910550 9/2000

OTHER PUBLICATIONS

International Search Report for International Application No. PCT/FR2005/000146, 4 pages.

* cited by examiner

*Primary Examiner*—Gunyoung T Lee
(74) *Attorney, Agent, or Firm*—Meyertons, Hood, Kivlin, Kowert & Goetzel, P.C.; Eric B. Meyertons

(57) ABSTRACT

String and support for light-emitting diodes having a capsule and, at a rear end of said capsule, electrical connecting pins, in which encapsulating blocks embed the rear parts of said diodes, said pins, the end parts of the connecting wires connected to these pins and the adjacent end parts of their sheaths. Also described is a chain of light-emitting diodes, comprising sheathed flexible electrical supply wires and a multiplicity of strings, of which the end wires are connected respectively to said supply wires. Additionally, a luminous device with light-emitting diodes, comprising at least one board having a multiplicity of traversing holes, at least one string of light-emitting diodes and/or at least one chain of light-emitting diodes, of which the diodes are engaged respectively in at least some of said holes of the board, from one side of the latter and are held.

22 Claims, 5 Drawing Sheets

STRING, CHAIN AND LUMINOUS DEVICE WITH LIGHT-EMITTING DIODES AND LIGHT-EMITTING DIODE SUPPORT

BACKGROUND OF THE INVENTION

1. Field of the Invention

The present invention relates to the general field of visual devices, for display, for signaling or for the presentation of information with light-emitting diodes and in particular in the field of luminous signs with light-emitting diodes.

2. Description of the Relevant Art

Currently, according to a first known variant, light-emitting diodes are attached to a printed circuit board in a particular arrangement corresponding to a luminous representation in two desired dimensions. Such a device requires the design of a printed circuit with the desired representation and the individual mounting of diodes on this circuit.

According to a second known variant, banks of light-emitting diodes are produced mounted in-line on a common support that is then attached to a support, the banks being connected by electrical connecting wires to an electrical supply component. Such devices require supports that are suitable for the attachment of banks and only enable representations to be obtained having straight parts corresponding to the length of the banks.

Moreover, the above devices require complementary sealing means so that they can be protected against the weather.

SUMMARY OF THE INVENTION

In one embodiment, means with light-emitting diodes enabling desired representations to be produced in any form and to simplify the operations of mounting diodes for the production of such representations is described.

In one embodiment, a string of light-emitting diodes having a capsule and, at a rear end of this capsule, electrical connecting pins is described.

According to an embodiment, said string includes light-emitting diodes mounted electrically in series between portions of sheathed flexible electrical connecting wires and encapsulating blocks embedding respectively the rear parts of said diodes, said pins, the end parts of the connecting wires connected to these pins and the adjacent end parts of their sheaths.

Also described is a light-emitting diode support having a capsule and, at a rear end of said capsule, electrical connecting pins connected to portions of sheathed flexible electrical connecting wires.

In one embodiment, said support includes an encapsulating block embedding the rear part of the diode, said pins, end parts of the connecting wires connected to these pins and the adjacent end parts of their sheaths.

In one embodiment, the encapsulating blocks preferably have a front face projecting with respect to the periphery of said diodes.

In one embodiment, the connecting wires preferably leave by a rear face of said encapsulating blocks.

In one embodiment, the encapsulating blocks are preferably cylindrical.

In one embodiment, the encapsulating blocks preferably have at least one projecting part on their periphery.

In one embodiment, the encapsulating blocks preferably have a front part with a smaller section than their rear part so as to have a peripheral shoulder, at least this front part having at least one annular rib or lip.

In one embodiment, at least some of said encapsulating blocks can advantageously include a cup-shaped casing of which the bottom is traversed by the associated diode so that this casing is open on the side of the pins of this diode, as well as a cast embedding material at least partially filling said casing.

In one embodiment, at least some of said encapsulating blocks can advantageously be at least partly of the same color or of a similar color to that of the associated diode in the luminous state.

One embodiment includes a chain of light-emitting diodes.

A chain of light-emitting diodes includes sheathed flexible electrical supply wires and a multiplicity of strings of which the end wires are connected respectively to said supply wires.

In one embodiment, said chain preferably includes encapsulating means embedding respectively the connections between the end wires of the string and the supply wires and embedding the adjacent end parts of their sheaths.

In one embodiment, said string or said chain may include at least one electrical or electronic component integrated or embedded in at least some of said means of encapsulation.

One embodiment includes a luminous device with light-emitting diodes.

A luminous device with light-emitting diodes includes at least one board having a multiplicity of traversing holes, at least one string of light-emitting diodes as defined above and/or at least one chain of diodes as defined above, of which the diodes are engaged respectively in at least some of said holes of the board, from one side of the latter and are held.

In one embodiment, the diodes are preferably engaged in the holes of the board until said encapsulating blocks butt up against this board.

In one embodiment, the holes of the board are preferably dimensioned so that the diodes are held with a press fit.

In one embodiment, said encapsulating blocks preferably have a shoulder butting up against said board.

In one embodiment, said encapsulating blocks preferably have at least one annular rib or lip so as to be wedged in said holes.

In one embodiment, said encapsulating blocks are preferably engaged in the holes of the board, the latter being dimensioned so that the encapsulating blocks are held with a press fit.

In one embodiment, said diodes and/or encapsulating blocks can advantageously be adhesively bonded to said board.

BRIEF DESCRIPTION OF THE DRAWINGS

The present invention will be better understood on studying means with light-emitting diodes, in particular for producing luminous devices for signaling, for the presentation of information or for luminous signs, described by way of non-limiting examples and illustrated by the drawings in which.

Figure 1:
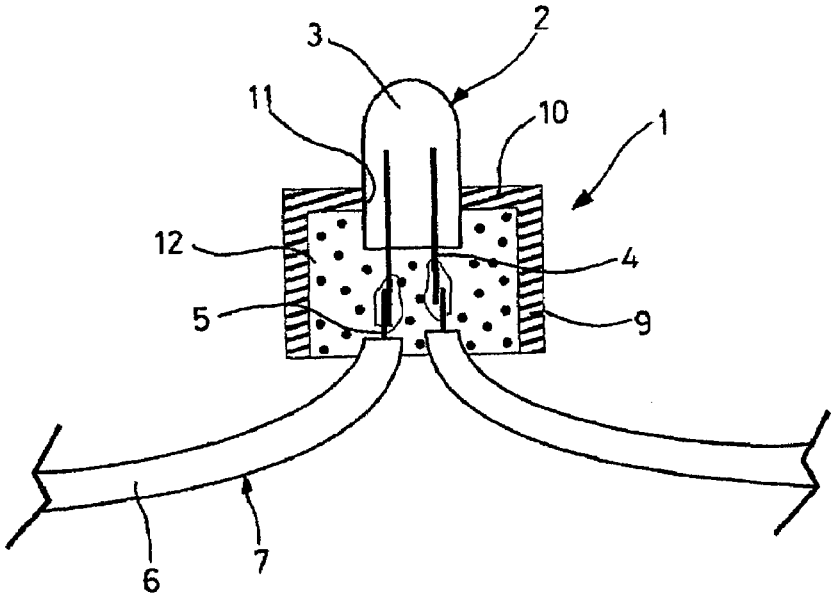
FIG. 1 shows an axial section of a light-emitting diode support.

While the invention is susceptible to various modifications and alternative forms, specific embodiments thereof are shown by way of example in the drawings and will herein be described in detail. It should be understood, however, that the drawing and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Referring to FIG. 1, it can be seen that a support 1 for a light-emitting diode 2 has been shown including a cylindrical capsule 3 and, at the rear of this capsule 3, electrical connecting pins 4 on which are soldered the bared ends of the electrical connecting wires 5 enveloped in the sheaths 6 of the flexible electrical cables 7.

The support 1 includes a casing 8 in the form of a cup which has a substantially cylindrical wall 9 and a bottom 10, this casing being made for example of a rigid plastic.

The bottom 10 of the casing 8 has a central traversing passage 11 into which the capsule 3 of the diode 2 is engaged axially, preferably without any play, so that the casing is open on the side of the pins 4 and 5.

The casing 8 is substantially filled with an embedding material 12 in which the rear part of the capsule 3, the pins 4, the bared end parts of the electrical connecting wires 5 connected to these pins and the end parts of the adjacent sheaths 6 are embedded.

Accordingly, the support 1 constitutes a sealed encapsulating block.

In a manufacturing variant, it is possible to proceed in the following manner.

The bared ends of the electrical connecting wires 5 are soldered onto the pins 4 of the diode 2.

The casing 8 on the capsule 3 of the diode 2 is passed through its hole 11 so that the rear part of this diode 2 slightly projects inside this casing 8.

With the casing 8 placed so as to be open upwards, the embedding material 12 is poured into the casing 8. This embedding material can include a resin that hardens at room temperature under the effect of heat. Preferably, this material 12 is chosen so as to adhere to the casing 8, to the capsule 3 of the diode 2 and to the sheath 6 of the cable 7 so as to provide a perfect seal.

The above operations can naturally be carried out with the aid of suitable holding and/or positioning tools.

Advantageously, the casing 8 and/or the embedding material 12 can be of the color or of a similar color to that of the diode 2, in the luminous state.

Figure 2:
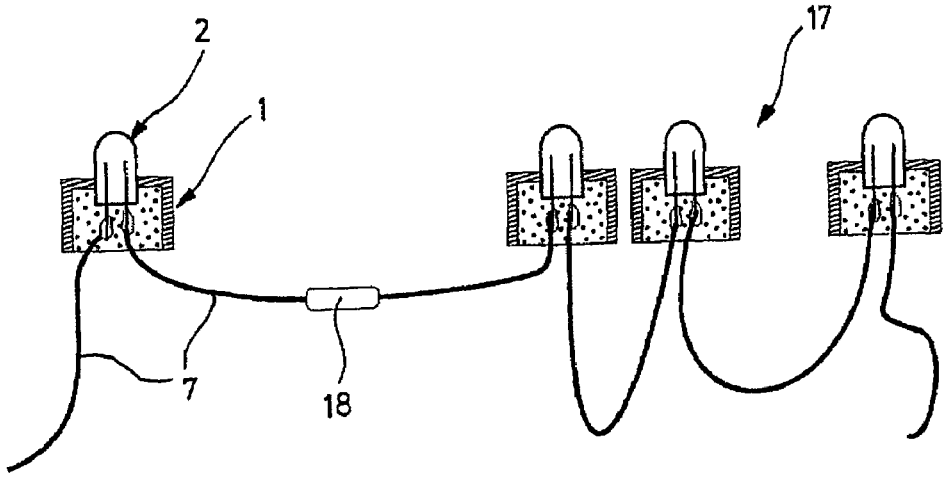
FIG. 2 shows a string of light-emitting diodes.

Referring to FIG. 2, it can be seen that a string 17 has been shown of several light-emitting diodes 2 carried respectively by the supports 1 and mounted electrically in series between portions of flexible electrical cables 7.

For producing such a string 17, it is possible to proceed in the following manner.

The bared ends of the electrical connecting wires 5 of the portions of electrical cable 7 are soldered respectively on the pins 4 of the diodes, so as to obtain an assembly in series of these diodes between these portions of electrical cables.

As described with reference to FIG. 1, supports 1 are produced, associated with each of the diodes 2, this production being facilitated by using suitable holding and/or positioning tools.

A flexible deformable string 17 of diodes 2 mounted in series is then obtained.

In addition, one of the cables 7 can be sectioned so that an electrical or electronic component 18, for example an electrical resistor, can be mounted in series on this cable.

Figure 3:
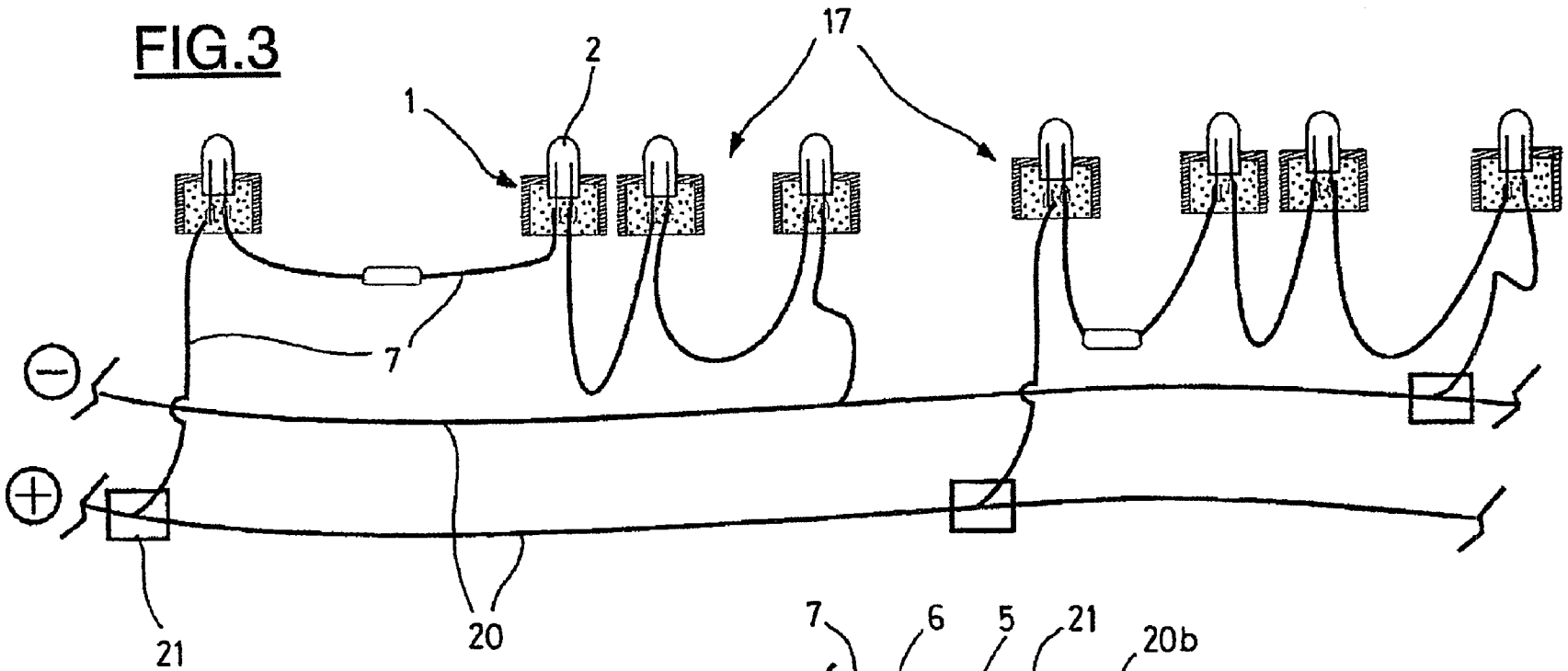
FIG. 3 shows a chain of light-emitting diodes.

Referring to FIG. 3, it can be seen that a chain 19 has been shown which includes flexible electrical supply cables to which there are connected respectively, at points along their length, the free ends of the end electrical cables 7 of several strings 17, so as to constitute an assembly in parallel of these strings 17 on these cables 20.

Figure 4:
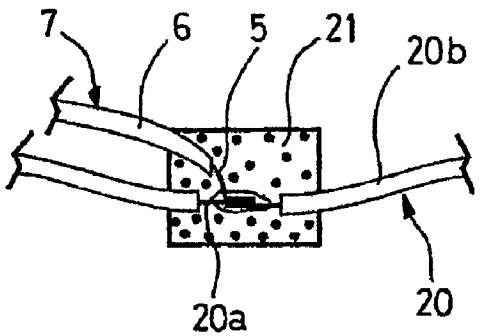
FIG. 4 shows a sectional detail of FIG. 3.

In an alternative embodiment shown in FIG. 4, the free ends of the end cables 7 of the strings 17 can be bared as well as short spaced portions of the supply cables 20, and then can be soldered respectively. Then, the bared parts of the corresponding wires 5 and 20*a* of the cables 7 and 20 and the adjacent end parts of the sheaths 6 and 20*b* of the cables 7 and 20 are immersed in an embedding material 21 such as an embedding resin so as to obtain sealed connections.

Figure 5:
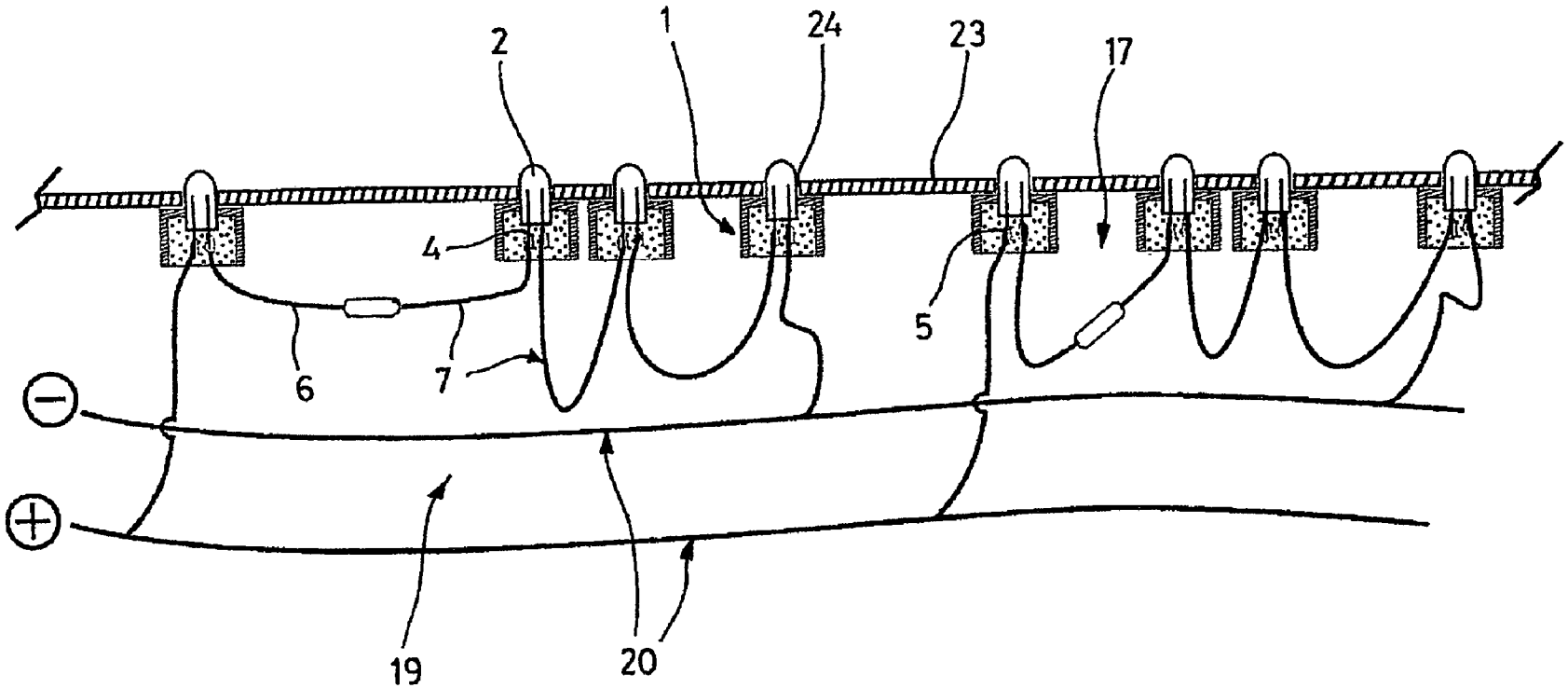
FIG. 5 shows a sectional view of a luminous device with light-emitting diodes.
Figure 6:
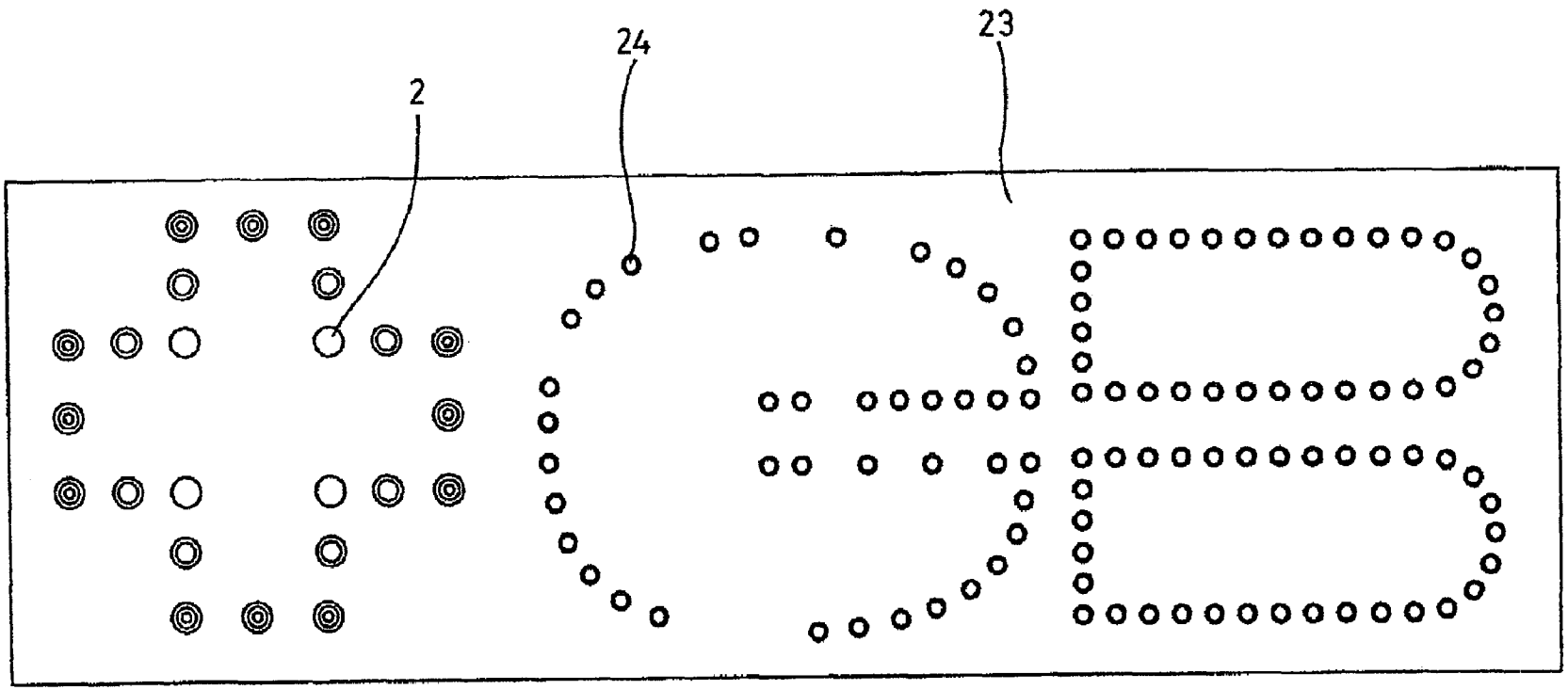
FIG. 6 shows a view from above of a representation with light-emitting diodes.

Referring to FIGS. 5 and 6, it can be seen that a luminous device 22 has been shown which includes a board 23, for example made of plastic, in which a multiplicity of traversing holes 24 has been provided so as to constitute, by means of points, a visual representation and which includes at least one chain 19 mounted on the board 23.

In the variant shown, the light-emitting diodes 2 of this chain are respectively engaged from one side in the holes 24 of the board 23, until their support 1 butts up against this board, the diodes 2 protruding from the other side of the latter.

The holes 24 are preferably dimensioned so as to receive the diodes 2 without any play so that the diodes are held for example with a press fit. Advantageously, an adhesive can be interposed between the board 23 and the supports 1 and/or the diodes 2, possibly to constitute a sealed connection.

In another variant, the supports 1 could be engaged in the holes 24. The holes 24 could then be dimensioned so as to receive the supports 1 without any play so that these supports would be held for example with a press fit. Advantageously, an adhesive could be interposed between the board 23 and the support 1.

Figure 7:
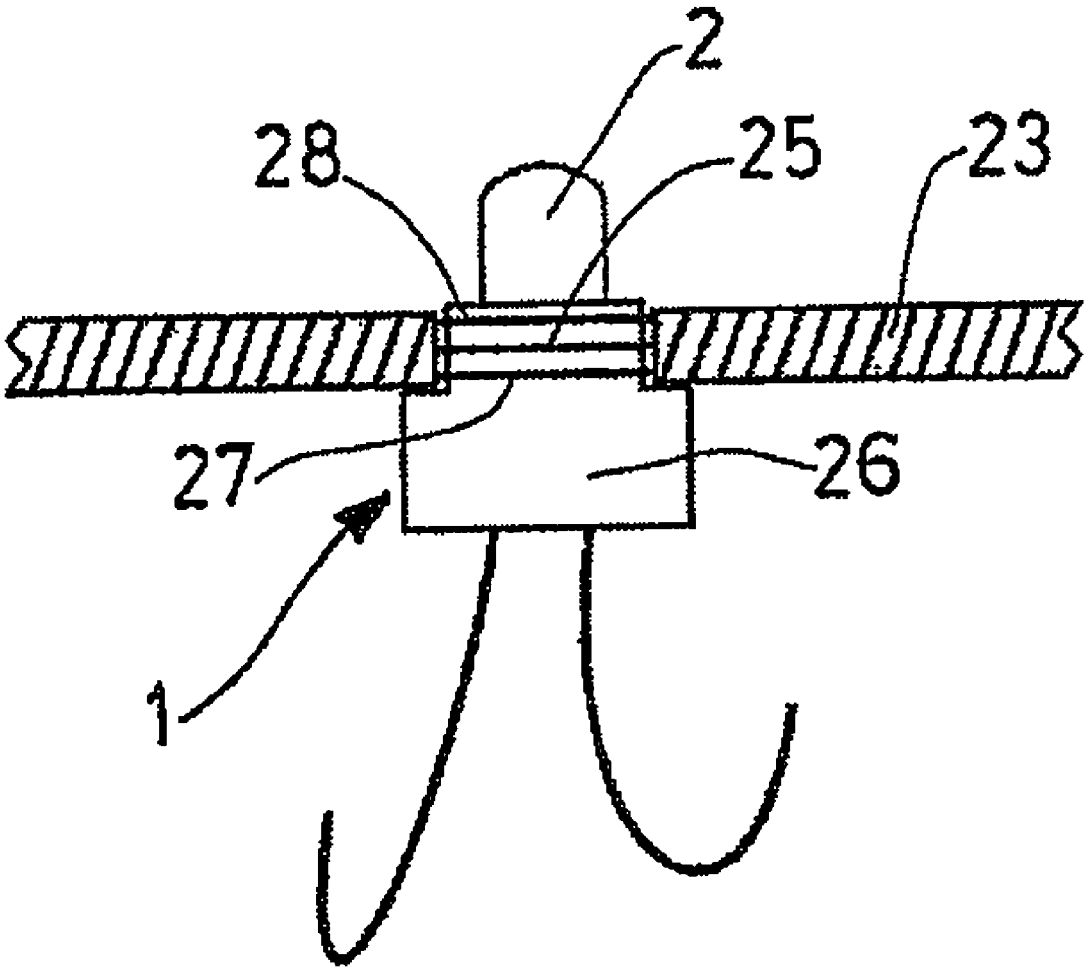
FIG. 7 shows a sectional view of a variant of a support.

According to the variant of FIG. 7, the supports 1 have a cylindrical front part 25, engaged in a hole 24 of the board 23, and a cylindrical rear part 26 providing between them an annular shoulder 27 resting on or butting up against the board 23. The cylindrical front part 25, of which the thickness corresponds substantially to the thickness of the board 23, has peripheral annular ribs or lips that are axially spaced and that are dimensioned so as to ensure the aforementioned press fit or wedging. The annular shoulder 27 is in fact produced on the peripheral wall 9 of the aforementioned casing.

In order to produce the luminous device 22, it is possible to proceed in the following manner.

The holes 24 are produced in the board 23.

The diodes 2 of the chain 19 are then installed one by one respectively in the holes 24 of the board 23.

After this, the device 22 can be installed in a casing (not shown) having for example a transparent board in front of and at a distance from the front ends of the diodes 2 and the supply wires 20 can be connected to a source of current. This source of current may possibly be associated with an electronic control circuit (not shown) for controlling the intensity of the light emitted by the diodes 2 so as to produce light effects.

The result of the preceding process is that, by means of the flexible connecting wires between the diodes 2, the holes 24 in the board 23 can be made in any location on the latter, possibly at different distances, and the diodes 2 can be mounted there, the maximum distance between the holes being fixed simply by the length of the cable 7, it being possible for this length to be chosen at will.

It is also possible to associate several chains 19, strings 17 or chains 19 having light-emitting diodes with different colors, with the different holes 24 of the board 23, each of which can be controlled independently so as to produce different light effects. The aforementioned arrangement, according to which the supports have approximately the color of the associated diodes, constitutes a visual reference making it possible to facilitate the mounting of the strings 17 or of the chains 19 having light-emitting diodes of different colors.

It is also possible to mount strings 17 and/or chains 19 on boards that are not flat, so as to produce representations in three dimensions.

In a variant, it could also be possible to consider the production of strings and chains having, on each support 1, several light-emitting diodes positioned beside each other, possibly of different colors and in this case connected to possibly grouped different electrical connecting wires and possibly grouped different electrical supply wires, this in order to obtain visual representations of which the colors can be varied.

As examples, the means described above with reference to the appended figures can advantageously be applied to the production of visual devices for display, signaling or the presentation of information such as luminous signs.

The present invention is not limited to the special examples of embodiments described above. Many variants are possible without departing from the scope of the appended claims.

What is claimed is:

1. A support for a light-emitting diode having a capsule and, at a rear end of the capsule, electrical connecting pins connected to portions of sheathed flexible electrical connecting wires, the support comprising an encapsulating block embedding the rear parts of the diode, said pins, the end parts of the connecting wires connected to these pins and the adjacent end parts of their sheaths; and wherein the encapsulating block further comprises:

a substantially cup-shaped casing, wherein the bottom of the casing comprises a through-hole engaging the capsule of the diode without any clearance, so that the casing is open on the side of the pins of the diode;

a cast embedding material at least partially filling said casing and embedding at least the rear part of the capsule; and the encapsulating block has a front part with a smaller section than the rear part so as to have a peripheral shoulder, the front part having at least one annular rib or lip wedged in a mounting hole.

2. The support according to claim 1, wherein the encapsulating block has a front face projecting with respect to the periphery of the diode.

3. The support according to claim 1, wherein the connecting wires leave by a rear face of said encapsulating block.

4. The support according to claim 1, wherein the encapsulating block is cylindrical.

5. The support according to claim 1, wherein the periphery of the encapsulating block comprises at least one projecting part.

6. The support according to claim 1, wherein the encapsulating block is at least partly of the same color or of a similar cooler to that of the diode in the luminous state.

7. A string of light-emitting diodes mounted electrically in series between portions of sheathed flexible electrical connecting wires, wherein at least one diode comprises:

a capsule and, at a rear end of the capsule, electrical connecting pins; and an encapsulating block embedding respectively the rear parts of said diode, said pins, the end parts of the connecting wires connected to the pins and the adjacent end parts of the sheaths;

wherein the encapsulating block comprises:

a substantially cup-shaped casing, wherein the bottom of the casing comprises a through-hole engaging the capsule of the diode without any clearance, so that the casing is open on the side of the pins of the diode;

a cast embedding material at least partially filling said casing and embedding at least the rear part of the capsule; and the encapsulating block has a front part with a smaller section than the rear part so as to have a peripheral shoulder, the front part having at least one annular rib or lip wedged in a mounting hole.

8. The string according to claim 7, wherein the encapsulating block has a front face projecting with respect to the periphery of said diodes.

9. The string according to claim 7, wherein the connecting wires leave by a rear face of said encapsulating block.

10. The string according to claim 7, wherein the encapsulating block is cylindrical.

11. The string according to claim 7, wherein the periphery of the encapsulating block comprises at least one projecting part.

12. The string according to claim 7, wherein said encapsulating block is at least partly of the same color or of a similar color to that of the associated diode in the luminous state.

13. A chain of light-emitting diodes, comprising: sheathed flexible electrical supply wires and a multiplicity of strings according to claim 7, of which the end wires of the strings are connected respectively to said supply wires.

14. The chain of light-emitting diodes according to claim 13, further comprising encapsulating means embedding respectively the connections between the end wires of the strings and the supply wires and embedding the adjacent end parts of their sheaths.

15. The chain of light-emitting diodes according to claim 14, further comprising at least one electrical or electronic component integrated or embedded in at least some of said encapsulating means.

16. A luminous device with light-emitting diodes, comprising at least one board having a multiplicity of traversing holes, at least one string of light-emitting diodes as described in claim 7, of which the diodes are engaged respectively in at least some of said holes of the board, from one side of the latter and are held.

17. The device according to claim 16, wherein the diodes are engaged in the holes of the board until said encapsulating block butts up against the board.

18. The device according to claim 16, wherein the holes of the board are dimensioned so that the diodes are held with a press fit.

19. The device according to claim 16, wherein said encapsulating block is engaged in at least one of the holes of the board, the latter being dimensioned so that the encapsulating block is held with a press fit.

20. The device according to claim 19, wherein said encapsulating block has a shoulder butting up against said board.

21. The device according to claim 19, wherein said encapsulating block has at least one annular rib or lip so as to be wedged or held with a press fit in said at least one hole.

22. The device according to claim 16, wherein the diodes and/or encapsulating block is adhesively bonded to said board.

* * * * *